United States Patent [19]

Credle

[11] 4,319,441

[45] Mar. 16, 1982

[54] AUTOMATIC DISPENSING SYSTEM

[75] Inventor: W. S. Credle, Stone Mountain, Ga.

[73] Assignee: The Coca-Cola Company, Atlanta, Ga.

[21] Appl. No.: 203,484

[22] Filed: Nov. 3, 1980

Related U.S. Application Data

[63] Continuation of Ser. No. 69,529, Aug. 24, 1979, abandoned.

[51] Int. Cl.[3] ..... B65B 1/04; B65B 61/26

[52] U.S. Cl. ..... 53/131; 53/282; 53/315

[58] Field of Search ..... 53/131, 282, 313, 314, 53/315, 316

[56] References Cited

U.S. PATENT DOCUMENTS

| | | | |
|---|---|---|---|
| 1,920,869 | 8/1933 | Kronquet | 53/314 |
| 2,981,041 | 9/1961 | Melville | 53/131 |
| 3,492,785 | 2/1970 | Mancini | 53/282 |
| 3,527,020 | 9/1970 | Mancini | 53/282 |
| 3,572,007 | 3/1971 | Shelbey | 53/282 |
| 3,994,117 | 11/1976 | Kinney | 53/282 X |

FOREIGN PATENT DOCUMENTS

| | | | |
|---|---|---|---|
| 766597 | 9/1967 | Canada | 53/282 |
| 684272 | 12/1952 | United Kingdom | 53/314 |

*Primary Examiner*—John Sipos

*Attorney, Agent, or Firm*—Birch, Stewart, Kolasch and Birch

[57] ABSTRACT

A Post-mix drink dispensing system is described including the combination of a cup dispenser, a means for introducing soft drink ingredients into the cups, an ice dispenser for depositing ice in the cups, an automatic lid dispenser for capping the cups, and a marker for marking the lids with indicia identifying the contents of the cup. The system includes a carousel arrangement wherein a cup is rapidly moved through a substantially circular arc to various stations which perform the above operations in rapid sequence.

15 Claims, 3 Drawing Figures

AUTOMATIC DISPENSING SYSTEM

This application is a continuation of copending application Ser. No. 069,529, filed on Aug. 24, 1979, now abandoned.

BACKGROUND OF THE INVENTION

This invention relates to an automatic drink dispensing system and more specifically to a completely, self-contained drink dispenser for use with a Post-mix system. The system automatically and sequentially dispenses cups, the necessary beverage ingredients, applies a lid over the filled cup, marks the lid with the designated flavor, and in turn delivers the packaged product.

With the explosion of the fast food service industry in this country, the development of an auotmatic drink dispensing system which could reduce the labor and time required to prepare a soft drink would be highly desirable. Current soft drink dispensing equipment creates considerable labor expense in that each activity involved requires specific and separate manual operation. The development of a self-contained automatic dispensing system would minimize handling and substantially reduce the time necessary in the preparation of the drink. Heretofore, in order to satisfy the requirement of immediate service, drinks have been prepared ahead of time and left to stand until such time when they are needed. This approach leads to a diluting of the drink and in turn an inferior product. An efficient automatic dispensing system would eliminate the need for stock piling large quantities of drinks prior to peak sales periods.

Various techniques have been proposed for providing automated systems for dispensing soft drinks such as the utilization of conveyor type systems whereby cups are automatically introduced to a continuously moving flight conveyor which receives the cups and processes them forward through a cup filling station, a cup capping station and a cup discharge station. The cup filling means travels forward synchronously with the conveyor belt while filling the cups and a heat sealing device is provided whereby caps are heat sealed to the rims of the cups while traveling forward. A discharge station is provided for automatically lifting and transferring the cups. However, there are distinct disadvantages in such a system. For example, the conveyor type system was found to be too large and expensive to be adaptable to a small, self-contained Post-mix dispensing operation. Furthermore, the systems were inherently complicated by the requirement of a continuously moving drink dispensing apparatus and capping devices. In addition, at the present time, the film applicator approach to capping the drink is also considered to be too expensive as well as too large for use in a small, self-contained Post-mix dispensing appartus. Other techniques providing elaborate approaches for fulfilling each phase of a drink dispensing system such as at the ice dispensing station, the cap dispensing and sealing station or the beverage dispensing station, but with these disclosures therein lies the general overall disadvantage of the particular system being too large and/or expensive for utilization with a self-contained, compact post-mix drink dispensing system.

It is therefore, an object of the present invention to provide a Post-mix dispensing system which will overcome the above-noted disadvantages.

A further object of the present invention is to provide a self-contained, Post-mix dispensing system which will automatically dispense cups, ice and beverage mix, apply a lid to the cup, mark the lid, and eject the final packaged product in one systematic operation.

It is yet another object of the present invention to provide a completely automated composite Post-mix dispensing system which eliminates the heretofore high cost of labor required in the preparation of soft drinks.

Yet, still a further object of the present invention is to provide a Post-mix drink dispensing system which will substantially reduce the amount of time required to deliver a completely prepared beverage in response to demand.

It is a further object of the present invention to provide an automatic dispensing system which would eliminate the need for stock piling large numbers of finished drinks prior to their demand thus avoiding the dispensing of an inferior product.

Yet, still another object of the present invention is to provide a completely self-contained Post-mix drink dispensing apparatus which is economical, compact and reliable.

Other objects and further scope of applicability of the present invention will become apparent from the detailed description given hereinafter.

It should be understood however that this detailed description and accompanying specific drawings indicating preferred embodiments of the invention are given by way of illustration only since various changes and modifications within the spirit and scope of the invention will become apparent to those skilled in the art as a result of this detailed description. Any such changes and modifications should be considered to be within the scope of the present invention.

SUMMARY OF THE INVENTION

The foregoing objects and others are accomplished in accordance with the present invention generally speaking, by providing a self-contained Post-mix drink dispensing system comprising a cup dispenser, a means for introducing the ingredients of a soft drink and ice into the respective cup, an automatic lid dispenser which in response to the appropriate signal delivers a lid to the cup which in turn is snapped onto the cup by a lid applicator. The lid is marked with a designated flavor before or after application. The cup is processed through the complete cycle by a cup indexer which consists of an upper and lower arm with pockets at either end which contact the cup and move it from one station to the next. The pockets are provided such that they are adjustable for varying cup sizes. The cup indexer will rotate 180° and then stop with one set of pockets at a fill station for introducing the beverage mix and ice, and the opposite set of pockets at the lid applicator station. A cup ejector is provided which also consists of an upper and lower arm which contact the cup after the lid has been applied and move it out of the pockets of the cup indexer. The cup ejector moves through a 135° are to eject the cup and then reverses direction to return to its original position.

It has been determined in the course of the present invention that a small, marketable, self-contained automatic soft drink dispensing unit could be developed incorporating the process steps of discharging cups, dispensing the necessary ice and beverage mixes, applying a cover or cap to the cup, marking the lid and delivering or ejecting the capped drink onto a waiting platform. The expression automatic dispensing system when used in the course of the present invention is defined as referring to a Post-mix dispensing system which automates all of the above operations. The system qualifies as an automatic dispensing system if it prepares at least one drink flavor in a fully automated mode even though it may incorporate other non-automatic equipment such as, for example, in the introduction of additional flavors. That is, the system of the present invention qualifies as an automatic system if the dispenser will automatically produce at least one finished drink from the initiation of the cycle to its completion. The cycle will continue to repeat itself as long as it receives the appropriate signal from the operator calling for the dispensing of a finished drink. Or it could produce a continuous supply of drinks automatically until it is cut off.

The dispenser operates on an indexing carousel arrangement as will be further discussed below such that a single cup is dropped from a cup dispenser to the base plate of the unit, the indexer arms move the cup to the fill position where ice and the appropriate beverage mix are dispensed into the cup and, after a filling period, the indexer arms will move the cup sequentially past the capping station to the lid applicator station. A single lid, which has been dispensed at the same time the cup was dispensed, is engaged by the leading edge of the moving cup and pulls the lid onto the cup. At the final or lid applicator station, the cup further passes under a compression plate or roller which snaps the lid in place. The indexer arms stop with the cup under the compression plate. Lid markers mounted in the plate mark the lid designating the flavor of the drink dispensed. After being marked, a cup ejector ejects the finished drink from the dispenser onto a waiting platform, or conveyor, etc.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION OF THE DRAWINGS

Figure 1:
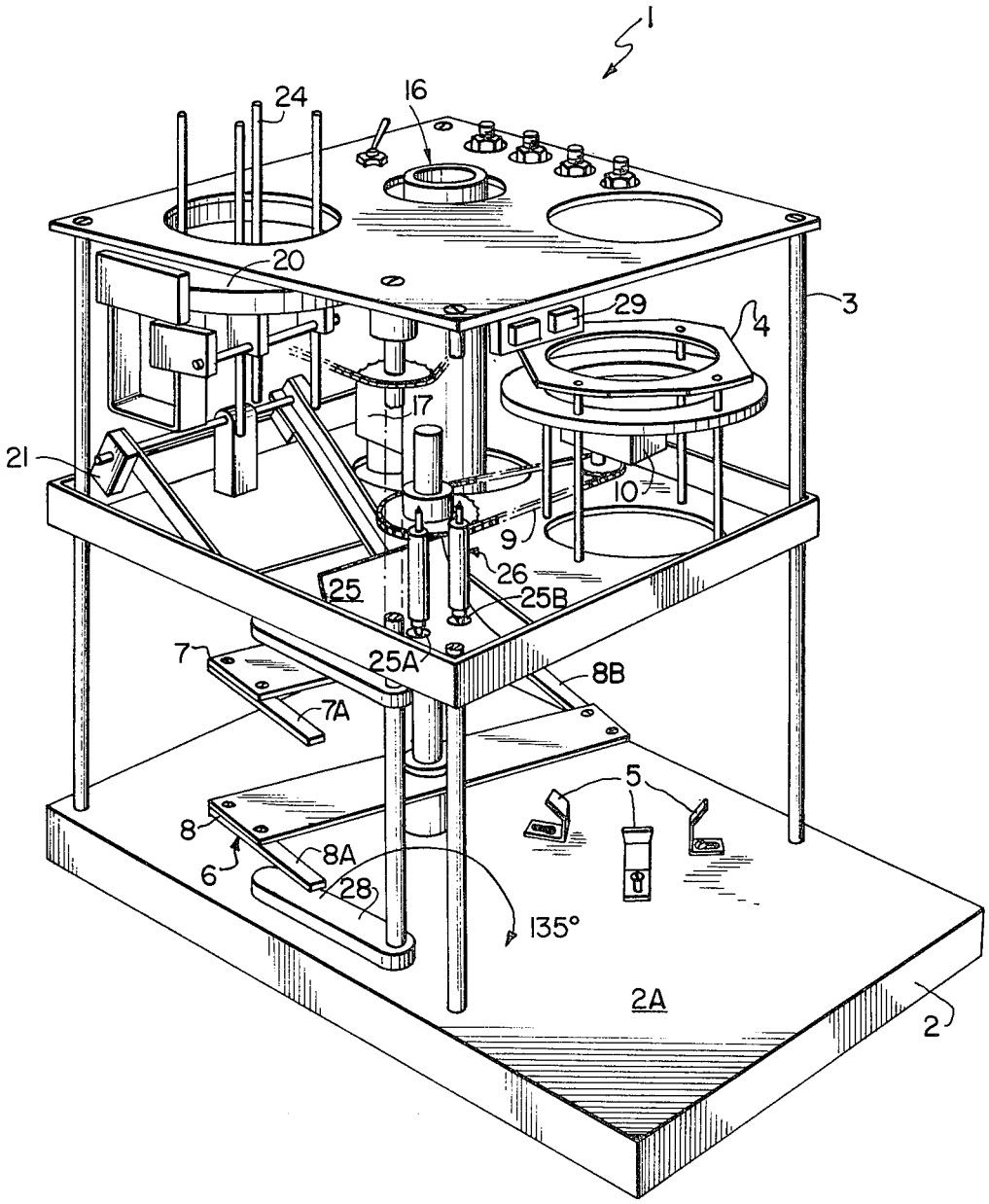
FIG. 1 represents a perspective view of the automatic dispenser of the present invention.

Referring now to FIG. 1, there is seen the automatic dispensing system of the present invention generally designated 1, comprising a base plate 2 in support of the frame 3. A ledge 2A is provided as a part of the base plate which protrudes from the front of the frame 3 onto which finished packaged drinks are discharged. At a first station of the automatic dispensing system, the cup dispenser assembly 4 is mounted on the frame 3 and positioned so as to discharge a cup to the base plate 2 upon receipt of the appropriate signal, where it is positioned by the guides or flanges 5. Any suitable cup dispensing mechanism such as is manufactured by Reed Industries, Inc. and commercially available therefrom may be used with the automatic soft drink dispensing system of the present invention. In general, a typical cup dispensing unit will have six cams which separate the bottom cup from a stack which cup in turn falls downward and is guided into position by the flanges 5. The particular cup dispensing unit is commonly operated by a single solenoid with a spring return. The cup dispenser is adjustable such that it can accomodate a variety of cup sizes ranging for example from 16 oz. to 24 oz.

A cup indexer generally designated 6 comprises upper and lower rotatable arms 7 and 8. The arms of the indexer have transverse bar members 7A, 7B, 8A, 8B at the ends thereof so as to form pockets which will engage the cup upon contact and carry it from one station to another. The pockets may be adjustable so that they can be adapted to various cup sizes. The pocket adjustment can be made manually or it can be so designed such that it can automatically change in size depending upon the diameter of the cup which it engages. This can be accomplished, for example, by incorporating a spring-loaded adjustable member on the ends of each of the respective arms 7 and 8. The indexer 6 is driven via a chain 9 by a shaded pole gear motor with a brake 10.

The automatic dispensing system of the present invention in a preferred embodiment has four stations arranged along a circular path. The first station is a cup dispensing station. The second station includes a dispensing nozzle for the post mix beverage ingredients, such as syrup and carbonated water, and an ice dispenser. The third station is a lid dispensing station and the fourth station includes a lid applicator and marker. If desired, the lid marker may be disposed at the third station for operation with the lid dispenser. The cup indexer 6 by means of upper and lower arms 7, 8 transports a cup from the first station along the circular path seriatum through the second, third and fourth stations in a manner to be described hereinafter with reference to FIG. 2.

The indexer 6 first engages a cup at the cup dispensing station, under dispenser 4 on route from the lid applicator station and stops with one set of cup carrying pockets at the second, or fill, station located beneath the ice dispenser tube 16 and the beverage dispensing valve 17 while the other set of pockets at the opposite ends of arms 7, 8 is at the lid, applicator and marking, or fourth station further discussed below. At the second station, the beverage mix is introduced through the dispensing valve 17 simultaneously with the dispensing of ice through the ice tube 16 into the cup. Rotation through 130° always begins with one set of pockets at the fourth or lid applicator station engaging the cup which has been dispensed from the cup dispenser 4 at the first station, and continuing on to the second station which is the ice and beverage dispensing station where it stops for a predetermined interval, thus completing the 180° period of rotation.

Any suitable ice dispenser and flavor dispensing valve may be used in combination with the automatic drink dispensing system of the present invention. The valve is such that it can introduce at least one flavor which can be automatically selected. However, a multi-flavor fast flow valve is preferred so as to greatly increase the servicability of the dispenser under the appropriate conditions. The automatic dispensing system of the present invention can be readily coupled to remote or under counter refrigeration units which cool post-mix beverage ingredients and delivers them to the dispensing system via an insulated hose.

After the filling cycle is complete the indexer arms again rotate 180° to move the cup through a third station where the lip of the moving cup engages a single lid which has been dispensed from lid dispenser 20 at the same time that the cup was dispensed from the cup dispenser 10. The lid dispensing mechanism with guide rods 24, more fully discussed with respect to FIG. 3 below, drops the respective lid into a chute 21 which comprises two rails 22 and 23 which guide the lid into position so as to engage the leading edge of the moving cup, as stated above. In a continuous operation, the cup is processed to the fourth station under a cam-shaped compression plate 25 which snaps the lid in place so as to secure the lid and prevent spillage of the beverage. This completes the second 180° period of rotation.

Figure 3:
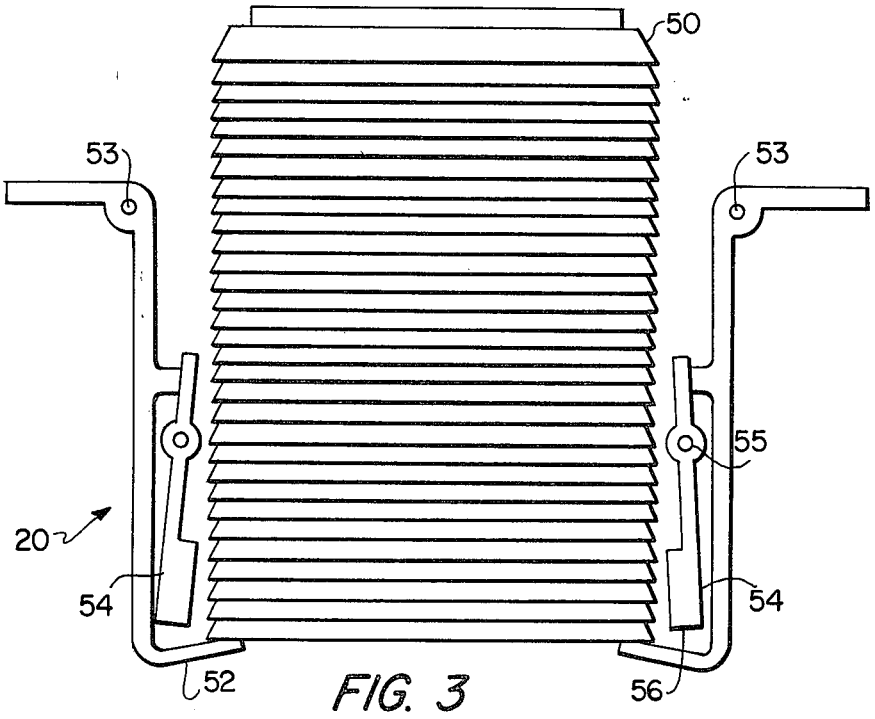
FIG. 3 represents the automatic lid dispensing mechanism of the present invention.

An example of a similar type of automatic capper to that described with reference to FIG. 3 is described in U.S. Pat. No. 2,917,880 to Hohl. The indexer arms stop the cup under the compression plate 25 and a lid marker 26 mounted above the plate, herein represented as having the capacity of marking two flavors on the lid of the container, descends to place the appropriate indicator on the lid. The compression plate is so designed so as to provide openings 25A, 25B through which the lid markers may project in response to the appropriate signal to place the proper designation on the surface of the lid.

The lid marker consists of a solenoid powered rubber stamp which automatically stamps the lid with the designated flavor such as X or Y after the cup and lid stop under the compression plate. The rubber stamp includes its own ink supply and does not have to be inked after each stamping.

The lid applicator or compression plate alternately can be spring loaded such that it is readily adaptable to cups of varying heights. As above stated, the indexer arms again stop having completed another 180° rotation, with the cup now being in the final station of the cycle, that being the lid applicator, marking or discharge station. A cup ejector 36 having upper and lower arms 27 and 28, respectively, which is driven by an eccentric shaft roller chain and powered by a shaded pol gear motor with brake (not shown) moves through a 135° are to engage the packaged product and eject the cup onto the surface of the protruding ledge 2A of the base plate 2. The ejector then reverses direction and returns to its original position. Power ON and OFF switches generally designated 29 activate the unit. Alternately, however, the unit may be activated by controls located remote from the housing.

Figure 2:
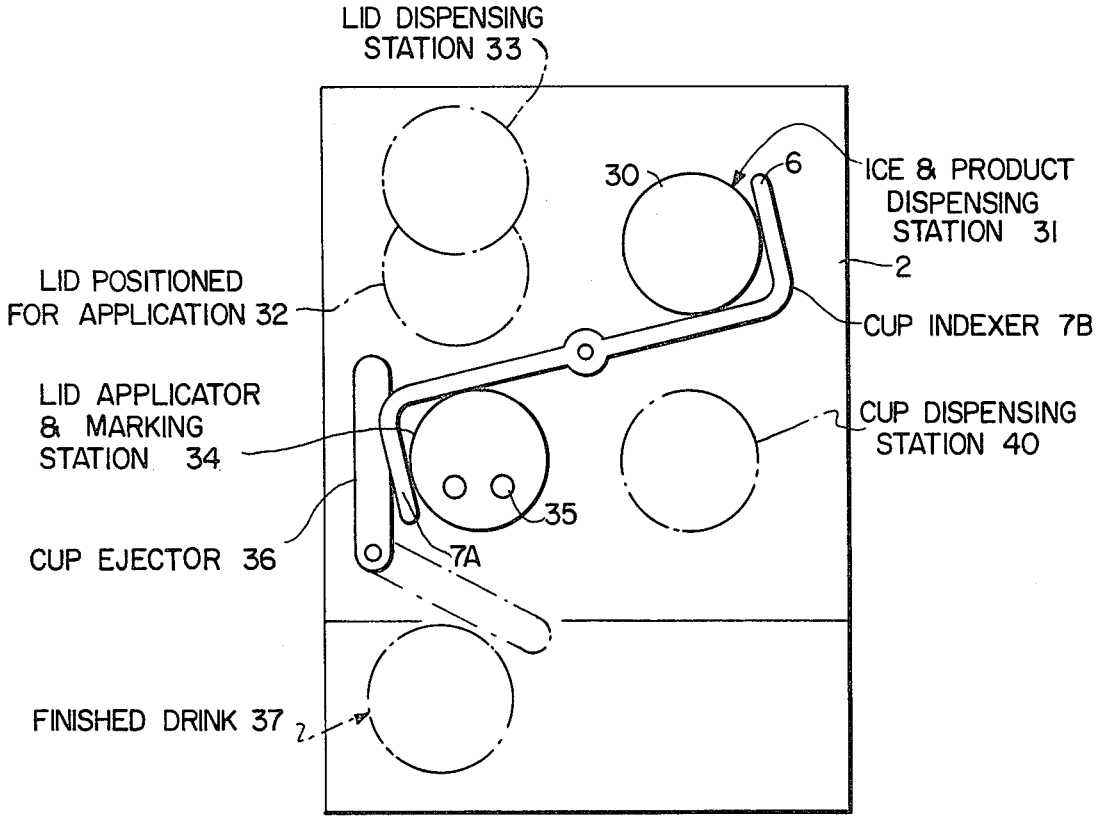
FIG. 2 represents a schematic plan view of the automatic dispenser of the present invention specifically illustrating the various stations through which the cup is processed in preparing the packaged drink.

Referring now to FIG. 2 there is seen in a schematic plan view of the automatic dispenser disclosed in FIG. 1 and diagrammatically represents the operation of the system as it proceeds through one complete cycle. The dispenser operates as stated above, on an indexing carosel arrangement. The indexer assembly always begins the heretofore mentioned 180° rotation cycle with one end at the lid marking station and one end at the ice and product dispensing station. That is, the position indicated in FIG. 2. After a cup 30 is dropped from the cup dispenser 4 and positioned at station 40 on the base plate 2, the end of the cup indexer 6 at the lid marking station moves through station 40 to the second station of the cycle or fill position picking up cup 30 along the way 31. The indexer 6 then stops and ice and beverage mix are dispensed into the cup 30. After a filling cycle, the indexer 6 again moves the cup through a third station 33 where a lid 32 has been dispensed from a lid dispenser 20. As the cup 30 proceeds past the lid discharge station the leading edge of the cup catches on the lid and pulls the lid onto the cup as explained hereinbefore. The cup indexer 6 continues its rotation so as to move the cup and lid to the fourth and final position in the completed cycle designated 34 wherein the lid and cup are moved under compression plate 25 (FIG. 1) which snaps the lid in plate. Lid markers are mounted above the compression plate which is so designed such that the marker can mark the lid as at 35 thus designating the particular flavor of the drink dispensed. Although the lid marking mechanism is herein represented as being positioned above the compression plate 25 at the final station 34 of the cycle, it can have other suitable locations such as at the site where the leading edge of the cup engages the lid. After marking, a cup ejector 36 discharges its capped drink from the dispenser as respresented by 37. The cup ejector moves through a 135° are to eject the cup and then reverses direction and returns to its original position. The cycle has now been completed with the cup indexer 6 having moved 360° starting and ending at the lid applicator station 34.

Referring now to FIG. 3, there is represented the automatic lid dispenser utilized in combination with the dispensing system of the present invention. Lids 50 are stacked vertically in the lid dispenser generally designated 51 which comprises support fingers 52 pivotally mounted at 53 and gripper fingers 54 pivotally mounted at 55. The gripper fingers 54 are provided with rubber pads 56 or gripper fingers. When the lid dispenser receives the appropriate signal to dispense a lid, four gripper fingers 54, two of which are herein illustrated engage the bottom four lids, excluding the bottom most lid, at the sight of the rubber pad 56 or gripper fingers to support the entire stack of lids. Four support fingers, two of which are herein illustrated, then retract and allow the bottom most lid to fall from the stack. After the bottom lid has been disposed, the support fingers return to their original position and the gripper fingers retract, thus allowing the entire stack to move down and be supported by the support fingers. The cycle is then repeated when another lid is needed. The solenoid operated dispenser is capable of dispensing lids at the rate of 60 lids per minute.

The automatic dispenser of the present invention generally is built in a compact, self-contained configuration so as to be readily applicable to fast food operations. Representative of the compactness that can be achieved by the dispensing unit herein described, the base dimensions of the dispensing system can be generally 14 inches square with a five inch ledge protruding from the front of the chasis onto which the packaged drinks are discharged. The dispenser can be built to a height of 18 inches with the lid dispenser guide rods protruding an additional sixteen inches above the top of the unit. The entire unit without the lids and cups weighs approximately 55 pounds. The dispensing unit is readily connected to pressurized, refrigerated units for dispensing the necessary beverage and ice components. The dispenser can dispense, fill, cap, mark and eject cups at a rate of approximately eight drinks per minute.

The invention being thus described, it will be obvious that the same may be varied in many ways. Such variations are not to be regarded as a departure from the spirit and scope of the invention and all such modifications as would be obvious to one of ordinary skill in the art are intended to be included within the scope of the following claims.

What is claimed is:

1. An apparatus for automatically filling a container with preselected ingredients and capping said container to form a package comprising;

surface means for supporting said container, said surface means having a plurality of stations disposed in a substantially circular path, through which said container passes in a predetermined sequence;

container dispensing means for automatically positioning an empty container at one of said stations in said circular path;

rotary arm means having a container receiving pocket on at least one end thereof, said pocket moving through said circular path as said arm means rotates, engaging said empty container at said one station and sequentially moving said container through each of the remaining ones of said plurality of stations;

ingredient dispensing means for filling said container with said preselected ingredients at the next one of said plurality of stations in said sequence;

lid applicator means for automatically capping the filled container at still another one of said stations as said container moves along through said circular path;

ejecting means for removing the capped and filled container from said surface; and drive means for moving said rotary arm means and said pocket thereon in a continuous motion through all of said plurality of stations without stopping said pocket at any stations except when filling said container and ejecting the same.

2. The apparatus of claim 1, wherein the station at which said container is filled and the station at which said container is removed by said ejecting means are diametrically disposed across said circular path and said drive means rotates said arm means in said continuous motion through 180 degree increments between said diametrically disposed stations.

3. The apparatus of claim 1, wherein said rotary arm means comprises first and second vertically spaced arm members, rotable in unison about a common axis, each of said arm members including at least one container-engaging pocket, the pocket of one of said arm members engaging said container adjacent the top thereof, the pocket of the other of said arm members engaging said container adjacent the bottom thereof.

4. The apparatus of claim 1, wherein said rotary arm means extends diametrically across said circular path and container pockets are disposed on both ends thereof on said circular path, whereby two containers may be processed simultaneously by said apparatus.

5. The apparatus of claim 3, wherein said rotary arm members extend diametrically across said circular path and container pockets are disposed on both ends of each arm member whereby two containers may be processed simultaneously by said apparatus.

6. An automatic apparatus for filling a container with preselected ingredients and capping said container to form a package comprising:

container dispensing means for automatically positioning an empty container at a first station within said apparatus;

indexing means for moving said container through a substantially circular path to second, third, and fourth stations, said indexing means including rotatable arm means having a container holding means at each end thereof to facilitate processing of two containers simultaneously by said automatic apparatus;

ingredient dispensing means at said second station for filling said container with said preselected ingredients;

lid dispensing means at said third station for automatically dispensing a lid onto said container as said container moves through said second station;

lid applicator means at said fourth station for pressing said lid into locking engagement with an open end of said container;

ejecting means for transfering said container from said fourth station to a serving surface; and control means for synchronizing the operation of each of the aforementioned means, said control means providing a control cycle including a dwell position for said rotatable arm means in which said ends of said arm means are disposed at said second and fourth stations for a predetermined dwell period to permit filling of one container and ejecting of another simultaneously, said control means further including means for moving said ends of said arm means through said first and third stations between said dwell periods in a continuous motion.

7. The apparatus of claim 6 or 1 wherein said ingredient dispensing means comprises an ice dispenser and at least one valve for introducing a liquid ingredient of a selected flavor into said container.

8. The apparatus as disclosed in claim 7, wherein said valve is a multiflavor fast flow valve.

9. The apparatus of claim 6 wherein said holding means comprise adjustable size pockets for receiving containers of different sizes.

10. The apparatus as disclosed in claim 6, wherein said lid dispensing means comprises four support fingers and four gripper fingers pivotally mounted so as to operate in tandem in the dispensing of the lids, said gripper fingers having rubber pads for engaging and holding said lids in a vertical stack during the lid dispensing cycle.

11. The apparatus of claim 10, said lid dispensing means further including an inclined chute for receiving one lid at a time form said vertical stack and gravity feeding said lid into engagement with the leading top edge of a container passing through said third station.

12. The apparatus of claim 6, wherein said ejecting means comprises pivotable arm means for engaging a container at said fourth station and transfering said container to said serving surface.

13. The apparatus of claim 6, wherein there is further provided means for marking said lid after application to a filled container with indicia identifying characteristics of the ingredients therein.

14. The apparatus of claim 13 wherein said means for marking is disposed adjacent said third station.

15. The apparatus of claim 13 wherein said means for marking is disposed at said fourth station.

* * * * *